United States Patent [19]

Rutter

[11] Patent Number: 4,768,988

[45] Date of Patent: Sep. 6, 1988

[54] WIND AND SURF PROPELLED AQUATIC DEVICE

[76] Inventor: John R. Rutter, 2828 61st St., #1011, Galveston, Tex. 77551

[21] Appl. No.: 948,028

[22] Filed: Dec. 31, 1986

[51] Int. Cl.[4] ..... A63H 23/00

[52] U.S. Cl. ..... 446/153; 43/3

[58] Field of Search ..... 446/268, 153, 159, 160, 446/156, 163; 43/3; 114/140

[56] References Cited

U.S. PATENT DOCUMENTS

| | | | |
|---|---|---|---|
| 2,237,194 | 4/1941 | Ohnmacht | 43/3 |
| 2,266,286 | 12/1941 | Tax | 43/3 |
| 2,967,503 | 1/1961 | Unger | 114/140 X |
| 3,834,054 | 9/1974 | Gentry et al. | 43/3 |
| 3,871,127 | 3/1975 | Heath | 446/163 |
| 3,896,578 | 7/1975 | Franceschini | 43/3 |

*Primary Examiner*—Mickey Yu

*Attorney, Agent, or Firm*—Neal J. Mosely

[57] ABSTRACT

A floating aquatic device, e.g. toy, boat, etc, which is propelled by the wind and surf comprises a buoyant body hull and a flat, generally triangular, horizontal keel plate secured to the bottom of the hull in a vertical spaced relation. The body hull has a concave rear portion which is of greater height and width relative to the remainder of the hull and configured in a manner to capture sufficient water and/or wind forces to propel the toy through the water in which it is floating by the forces co-acting with the concave rear portion of the hull. The generally triangular keel is of sufficient weight to maintain said hull in an upright floating position and to stabilize the device. The concave rear portion of the hull is configured to bifurcate the water and/or wind forces co-acting with the rear portion to orient the forward end of the toy in a direction opposed to the forces. The concave rear portion of the hull directs a portion of the water forces from the curl of the wave downwardly onto the wide rear portion of the keel plate to skim the device through the water.

6 Claims, 1 Drawing Sheet

WIND AND SURF PROPELLED AQUATIC DEVICE

BACKGROUND OF THE INVENTION

1. Field of the Invention

This invention relates generally to wind and surf propelled aquatic devices, and more particularly to a surf and wind propelled aquatic toy.

2. Brief Description of the Prior Art

Wind and water propelled floating devices are known in the art. There are several patents which disclose floating devices having keel and rudder designs and/or wind harnessing means for activating or propelling the devices.

Heath, U.S. Pat. No. 3,871,127 discloses a model sailing ship having an improved keel. The keel has a downwardly extending section attached to the hull and a horizontally extending section attached to the downwardly extending section. The keel is positioned so that the center of pressure of wind acting on the ship is in a forward position relative to the center of pressure of water acting on the ship to maintain the ship in a downwind direction.

Higgins, U.S. Pat. No. 2,368,834 and Dye, U.S. Pat. No. 3,798,820 disclose combination stabilizer and anchor line holders for duck decoys comprising a frame fitted in brackets on the bottom of the decoy. The anchor line having a weight attached is wrapped around the frame. The frame with the anchor line and weight attached serves as a counterweight to keep the decoy upright in water, and serves as a stand for the decoy on land or ice when the anchor line is stowed thereon. The Dye patent additionally provides a cylindrical counterweight.

Brinkop, Pitts, Ohnmacht, and Villatore et al, U.S. Pat. Nos. 364,573, 1,571,213, 2,237,194 and 1,813,370 respectively, disclose decoys having a depending standard or rudder blade which is pivotally attached to the decoy body or head and allows the body or head to oscillate due to the wave action or water current.

Gentry et al, U.S. Pat. No. 3,834,054 discloses a decoy having an elongated and bulbous keel and weights corrresponding to the outer configuration of the keel which are clipped thereon.

Dennison et al, U.S. Pat. No. 2,748,519 discloses a decoy having a rollable weighted ball which moves inside a housing attached to the bottom of the decoy. The decoy bobs and rotates in a horizontal plane in response to a slight wind.

Pontikis, U.S. Pat. No. 1,712,167 discloses a life saving boat having a keel comprising a plurality of superposed horizontal plates arranged in spaced relation, and at least one longitudinal vertical extending plate interposed between first and second horizontal plates.

The present invention is distinguished over the prior art in general, and these patents in particular by a floating aquatic device, e.g. toy, boat, etc., which is propelled by the wind and surf. The toy comprises a buoyant body hull and a flat, generally triangular, horizontal keel plate secured to the bottom of the hull in a vertically spaced relation. The body hull has a concave rear portion which is of greater height and width relative to the remainder of the hull and configured in a manner to capture sufficient water and/or wind forces to propel the toy through the water in which it is floating by the forces co-acting with the concave rear portion. The keel is of sufficient weight to maintain the hull in an upright floating position and stabilize the device. The concave rear portion of the hull is shaped to bifurcate the water and/or wind forces co-acting with the rear portion to orient the forward end of the toy in a direction opposed to the forces. The concave rear portion of the hull directs a portion of the water forces from the curl of the wave downwardly onto the wide rear of the keel plate to skim the device through the water.

SUMMARY OF THE INVENTION

It is therefore an object of the present invention to provide an aquatic device which when thrown upwind into the ocean surf will return in close proximity to the thrower.

It is another object of this invention to provide an aquatic toy which is propelled by the wind and wave action acting thereon.

Another object of this invention is to provide a surf and wind propelled aquatic toy having a keel plate which will maintain the toy in an upright position in the water and react with the water forces to skim the toy through the water in which it is floating.

Another object of this invention is to provide a floating aquatic toy having a body hull configured in a manner to capture sufficient water and/or wind forces to propel the toy through the water in which it is floating by the forces co-acting with the hull.

Another object of this invention is to provide a floating aquatic toy having a body hull shaped to bifurcate the water and/or wind forces co-acting with the rear portion to orient the forward end of the toy in a direction opposed to the forces, and a keel plate designed to facilitate the orientation and react with the water forces.

A further object of this invention is to provide a floating aquatic toy having a body hull which will direct a portion of the water forces from the curl of a wave downwardly onto the keel plate to skim the toy through the water in which it is floating.

A further object of this invention is to provide an aquatic toy which is propelled by the wind and wave action which will entertain and amuse children.

A still further object of this invention is to provide an aquatic toy which is propelled by the wind and wave action acting which is attractive in appearance, simple in design, economical to manufacture, and rugged and durable in use.

Other objects of the invention will become apparent from time to time throughout the specification and claims as hereinafter related.

The above noted objects and other objects of the invention are accomplished by the present floating aquatic device which is propelled by the wind and surf. The device comprises a buoyant body hull and a flat, generally triangular, horizontal keel plate secured to the bottom of the hull in a vertically spaced relation. The body hull has a concave rear portion which is of greater height and width relative to the remainder of the hull and configured in a manner to capture sufficient water and/or wind forces to propel the toy through the water in which it is floating by the forces co-acting with the concave rear portion. The keel is of sufficient weight to maintain said hull in an upright floating position and stabilize the device. The concave rear portion is shaped to bifurcate the water and/or wind forces co-acting with the rear portion to orient the forward end of the toy in a direction opposed to the forces. The concave rear portion of the hull directs a portion of the water forces from the curl of the wave downwardly onto the wide rear portion of the keel plate to skim the device through the water.

DESCRIPTION OF THE PREFERRED EMBODIMENT

Figure 1:
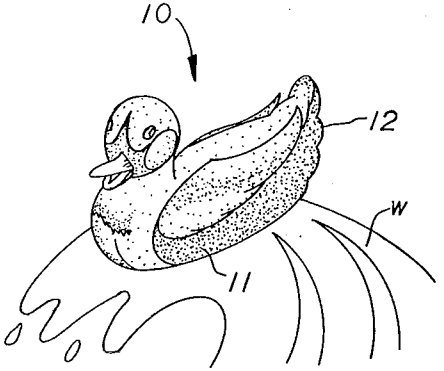
FIG. 1 is a pictorial illustration of preferred aquatic device, e.g. toy, etc., in the form of a small duckling which is floating on the crest of a wave and propelled by the wind and surf.

Referring to the drawings by numerals of reference, there is shown in FIGS. 1–4, a preferred aquatic device, e.g. toy, 10 in the form of a small duckling which is floating on the crest of a wave W and propelled by the wind and surf. The aquatic toy 10 comprises a buoyant body hull 11 having a concave rear portion 12. The concave rear portion forms the tail portion of the duckling and the topmost portion thereof extends above the back portion of the duckling. The tail or rear portion 12 is of greater height and width relative to the remainder of the hull and configured in a manner to capture sufficient water and/or wind forces to propel the toy 10 through the water in which it is floating by the forces of the wind and surf co-acting with the concave rear portion.

A pair of concave indentations 13 laterally spaced one to each side of the vertical axis of the concave rear portion 12 define a vertical ridge 14 with pockets on each side to bifurcate the water and/or wind forces co-acting with rear portion 12 to orient the forward end of the toy in a direction opposed to the forces.

A keel 15 is secured to the bottom of hull 11 in a vertically spaced relation and is of sufficient weight to maintain the toy 10 in an upright floating position. The keel 15 comprises a flat, generally triangular, horizontal plate 16 having an integral cylindrical spool-shaped spacer member 17 extending vertically between the top surface of the plate 16 and the bottom of the hull to allow water to flow therebetween. The top of the spacer 17 is molded into to the bottom of the hull or secured in any conventional manner, such as by cementing or screwing it in place.

Figure 3:
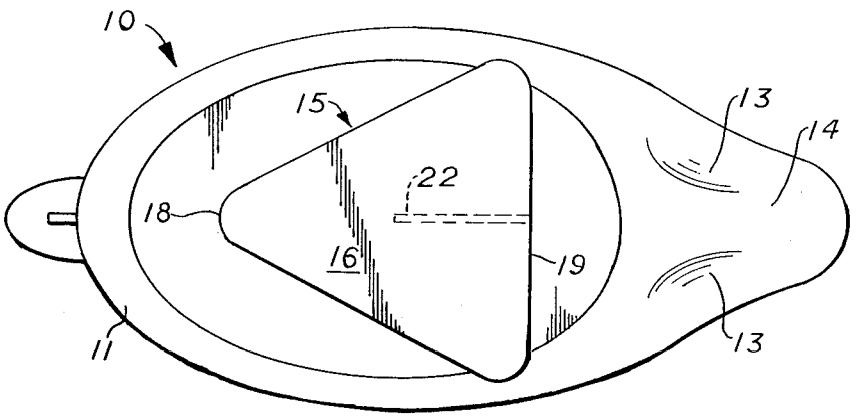
FIG. 3 is a bottom top plan view of the aquatic toy.
Figure 4:
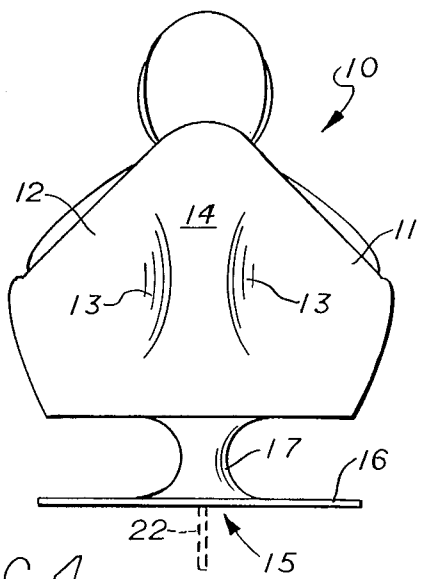
FIG. 4 is a rear elevation of the aquatic toy.
Figure 2:
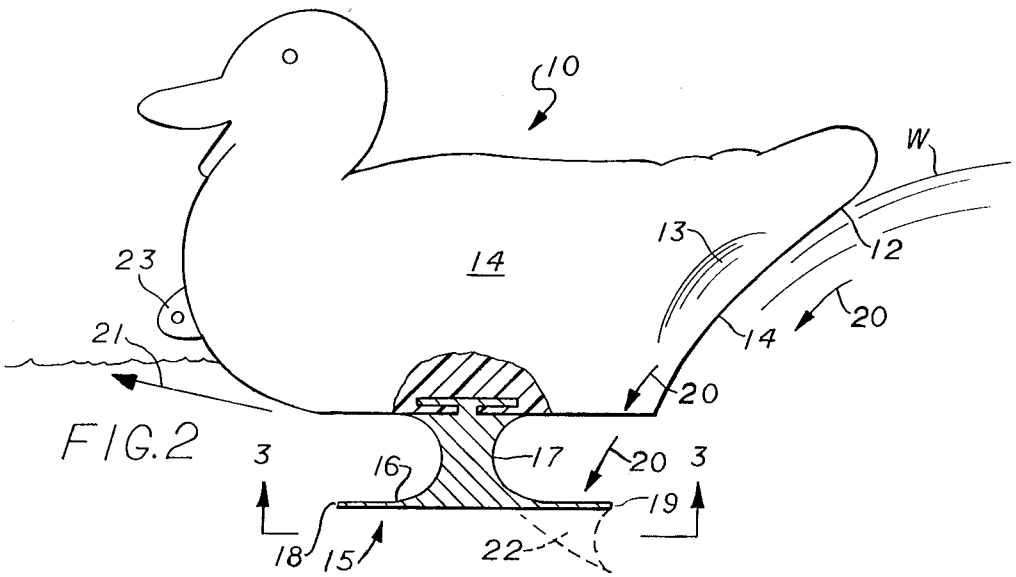
FIG. 2 is a side elevation of the floating aquatic toy of FIG. 1.

As best seen in FIG. 3, the flat horizontal plate 16 has substantially less transverse surface area at its forward end 18 than at its rearward end 19 whereby the rearward end provides more drag and vertical resistance than the forward end to water in which the toy is floating thereby facilitating forward movement.

As represented by arrows 20, the curl of the wave striking the concave tail portion directs a portion of the water forces downwardly onto the wide rear portion of the keel plate to further propel the toy through the water in a skimming action as shown by arrow 21.

Although other configurations may be used, the preferred horizontal plate 16 is a triangular configuration with the forward end 18 forming the apex. To further stabilize toy 10 as it moves through the water, a depending vertical fin 22 may be provided at the rearward end of plate 16.

An eyelet 23 may be provided on the forward end of the body hull 11 for attaching a string allowing the toy to be pulled through the water in situations where there is little or no wave activity and on lakes and ponds or other still bodies of water.

It has been found that a keel including the spacer weighing approximately one-third the weight of the buoyant body hull will produce satisfactory results. A preferred body hull weight is approximately 4 to $4\frac{1}{2}$ ounces, with a keel weight of from between $1\frac{1}{2}$ to 2 ounces. Although a duckling has been illustrated, it should be understood that other suitable shaped floatable bodies may be used, such as model ships and other aquatic figures.

It should also be understood that the principles of this invention are not limited to toys, but may be applied to utilitarian articles such as water fowl decoys for use in hunting without departing from the scope of the invention.

OPERATION

The aquatic toy may be used in various bodies of water, however, best performance occurs in the surf zone of a beach. The surf zone defined for purposed of this application being the wave activity in the area between the shoreline and the medium sized breakers. This zone extends approximately 20 to 50 feet from the beach and includes ten to fifteen waves.

The toy is thrown out into the surf zone in a direction into the wind. Wind and water action co-acting with the concave rear or tail portion of the duckling receive sufficient water and/or wind forces to orient the tail portion into the wind. This is due to the concavity, height, and width of the tail portion relative to the remainder of the body hull. In this position the tail portion receives forces of the incoming wave as it breaks.

The concave indentations laterally spaced one to each side of the vertical axis of the concave tail portion define a vertical ridge with pockets on each side which bifurcates the water and/or wind forces co-acting with the tail portion to orient the forward end of the toy in a direction opposed to the forces.

Because the flat horizontal keel plate secured to the bottom of the hull is of sufficient weight, the toy is maintained in an upright stable floating position in the turbulent water. The keel is spaced below the bottom of the hull to allow water to flow therebetween.

The triangular, flat horizontal keel plate has substantially less transverse surface area at its forward end than at its rearward end whereby the rearward end provides more drag and vertical resistance than the forward end to water in which the toy is floating. The curl of the wave striking the concave tail portion directs a portion of the water forces downwardly onto the wide rear portion of the keel plate to skim the toy through the water. A depending vertical fin at the rearward end of the horizontal keel plate further stabilizes the toy as it moves through the water. Each wave brings the device closer to the shore.

While this invention has been described fully and completely with special emphasis upon a preferred embodiment, it should be understood that within the scope of the appended claims the invention may be practiced otherwise than as specifically described herein.

I claim:

1. A floatable aquatic device propelled by the wind and surf comprising;

a buoyant body hull having a concave rear portion, said hull configured to resemble a water fowl and said concave rear portion forming the tail portion of the water fowl and the topmost portion thereof extending above the water fowl back portion, said rear portion being of greater height and width than the forward end of the hull to capture sufficient water and/or wind forces to propel the floatable aquatic device through the water in which it is floating by the forces coacting with the concave rear portion and having a pair of concave indentations laterally spaced one to each side of the vertical center of said concave rear portion to define a vertical ridge with pockets on each side which bifurcates the water and/or wind forces co-acting with the rear portion to orient the forward end of the floatable aquatic device in a direction opposed to the forces, a keel defined by a flat horizontal triangular plate secured to the bottom of the hull in a vertically spaced relation by a vertical spacer member to allow water to flow therebetween, said flat horizontal plate having substantially less transverse surface area at its forward end than at its rearward end whereby the rearward end provides more drag and vertical resistance than the forward end to water in which the floatable aquatic device is floating and the rearward end of said horizontal plate receiving sufficient downwardly directed water forces from waves striking the concave rear portion of said body hull to propel said floatable aquatic device through the water, the weight of said keel substantially one-third the weight of said buoyant body hull to maintain said hull in an upright floating position in turbulent water.

2. A floatable aquatic device according to claim 1 including a depending vertical fin centrally disposed at the rearward end of said horizontal plate for stabilizing said floatable aquatic device as it is propelled through the water.

3. A floatable aquatic device according to claim 1 including an eyelet on the forward end of said body hull for attaching a line by which the floatable body may be pulled through the water when there is little or no wave activity or on lakes and ponds or other still bodies of water.

4. A floating aquatic toy propelled by the wind and surf comprising;

a buoyant body hull having a concave rear portion, said hull configured to resemble a small duckling and said concave rear portion forming the tail portion of the duckling and the topmost portion thereof extending above the back portion of the duckling, said rear portion being of greater height and width than the forward end of the hull to capture sufficient water and/or wind forces to propel the toy through the water in which it is floating by the forces co-acting with the concave rear portion and having a pair of concave indentations laterally spaced one to each side of the vertical center of said concave rear portion to define a vertical ridge with pockets on each side which bifurcates the water and/or wind forces co-acting with the rear portion to orient the forward end of the toy in a direction opposed to the forces, a keel defined by a flat horizontal triangular plate secured to the bottom of the hull in a vertically spaced relation by a vertical spacer member to allow water to flow therebetween, said flat horizontal plate having substantially less transverse surface area at its forward end that at its rearward end whereby the rearward end provides more drag and vertical resistance than the forward end to water in which the toy is floating and the rearward end of said horizontal plate receiving sufficient downwardly directed water forces from waves striking the concave rear portion of said body hull to propel said toy through the water, the weight of said keel substantially one-third the weight of said buoyant body hull to maintain said hull in an upright floating position in turbulent water.

5. A floating aquatic toy according to claim 4 including a depending vertical fin centrally disposed at the rearward end of said horizontal plate for stabilizing said toy as it is propelled through the water in which it is floating.

6. A floating aquatic toy according to claim 4 including an eyelet on the forward end of said body hull for attaching a line by which the toy may be pulled through the water when there is little or no wave activity or on lakes and ponds or other still bodies of water.

* * * * *